US005564380A

United States Patent [19]

Kobayashi et al.

[11] Patent Number: 5,564,380

[45] Date of Patent: Oct. 15, 1996

[54] CAMSHAFT OPERATING SYSTEM

[75] Inventors: Manabu Kobayashi; Takamitsu Suzuki, both of Iwata, Japan

[73] Assignee: Yamaha Hatsudoki Kabushiki Kaisha, Iwata, Japan

[21] Appl. No.: 539,811

[22] Filed: Oct. 5, 1995

Related U.S. Application Data

[63] Continuation of Ser. No. 245,918, May 19, 1994, abandoned.

[51] Int. Cl.[6] ..... F02B 75/06

[52] U.S. Cl. ..... 123/192.2; 123/54.4

[58] Field of Search ..... 123/192.2, 90.27, 123/90.31, 54.4, 54.6, 54.7, 54.8; 74/603

[56] References Cited

U.S. PATENT DOCUMENTS

| | | | |
|---|---|---|---|
| 4,644,916 | 2/1987 | Kitagawa | 123/90.31 |
| 4,674,452 | 6/1987 | Asanomi | 123/90.31 |
| 4,716,864 | 1/1988 | Binder | 123/90.27 |
| 4,915,066 | 4/1990 | Koshimoto et al. | 123/90.31 |
| 5,184,581 | 2/1993 | Aoyama et al. | 123/90.31 |
| 5,216,984 | 6/1993 | Shimano et al. | 123/90.31 |
| 5,216,989 | 6/1993 | Iwata et al. | 123/90.31 |
| 5,297,508 | 3/1994 | Clarke et al. | 123/90.31 |

*Primary Examiner*—Noah P. Kamen

*Attorney, Agent, or Firm*—Knobbe, Martens Olson & Bear

[57] ABSTRACT

A valve trains drive assembly for a V-type engine which includes a balancing shaft. The valve train includes a flexible transmitter between a crankshaft sprocket and one of two camshafts in the cylinder heads as well as a sprocket around the balancing shaft. Each of the camshafts that are driven directly by the crankshaft then drive the opposed camshaft within each cylinder head via a transmission. The transmissions within each cylinder head between camshafts may be located at the forward or at the rear end thereof. Both the intake camshafts, or both the exhaust camshafts, or a combination thereof may be directly driven by the crankshaft sprocket. An improved breather oil separator is positioned between the balancing shaft and an induction system.

24 Claims, 13 Drawing Sheets

CAMSHAFT OPERATING SYSTEM

This application is a continuation of U.S. patent application Ser. No. 08/245,918, filed May 19, 1994, now abandoned.

BACKGROUND OF THE INVENTION

This invention relates to a camshaft operating system for an internal combustion engine, and more particularly to an improved drive arrangement for a multiple cam V-type overhead valve engine.

The advantages of twin overhead camshafts in improving engine performance are well known. However, the use of multiple camshafts for an engine, particularly when the engine is disposed at a V-arrangement, presents some problems. That is, all camshafts should be driven at one-half engine speed, and it is desirable to maintain a relatively simple and uncomplicated drive arrangement. Various arrangements have been proposed for V-type engines wherein one camshaft of each cylinder bank is driven from the crankshaft, and the driven camshaft drives the other camshafts through some form of mechanism. A wide variety of alternative arrangements have been proposed in the prior art for such drives.

However, with certain types of V-engines, it is also desirable to provide a balancer shaft arrangement for balancing the engine. This may be employed, for example, where the engine is designed so as to have the cylinder banks disposed at an angle other than the optimum angle at which even firing impulses result. When uneven firing impulses are employed, it is desirable to provide a balancer arrangement so as to compensate for these unbalanced forces. Of course, the drive for the balancer shaft and the location of the balancer shaft further complicates the arrangement.

It is, therefore, a principal object of this invention to provide an improved balancer camshaft drive arrangement for a multiple valve V-type engine.

It is a further object of this invention to provide an improved V-type of engine having a balancer shaft disposed in the valley between the cylinder banks and driven by the same drive that drives one camshaft of each cylinder bank.

SUMMARY OF THE INVENTION

This invention is adapted to be embodied in a camshaft drive arrangement for driving the overhead camshafts of a V-type four-cam engine, comprising a cylinder block having a pair of cylinder banks disposed at a V-angle to each other and defining a valley therebetween. A pair of cylinder head assemblies are provided, and each is affixed to a respective one of the cylinder banks. A crankshaft is supported for rotation about an axis disposed at the base of the cylinder block. A first pair of camshafts are rotatably journalled by one of the cylinder heads for operating the valves therein, and a second pair of camshafts are rotatably journalled by the other of the cylinder heads for operating the valves therein. A balancer shaft is journalled by the cylinder block in the valley. A first flexible transmitter drives one camshaft of each pair, and the balancer shaft from the crankshaft. First and second transmissions drive the other camshafts of the respective pair from the crankshaft driven camshaft.

DESCRIPTION OF THE PREFERRED EMBODIMENTS

Figure 1:
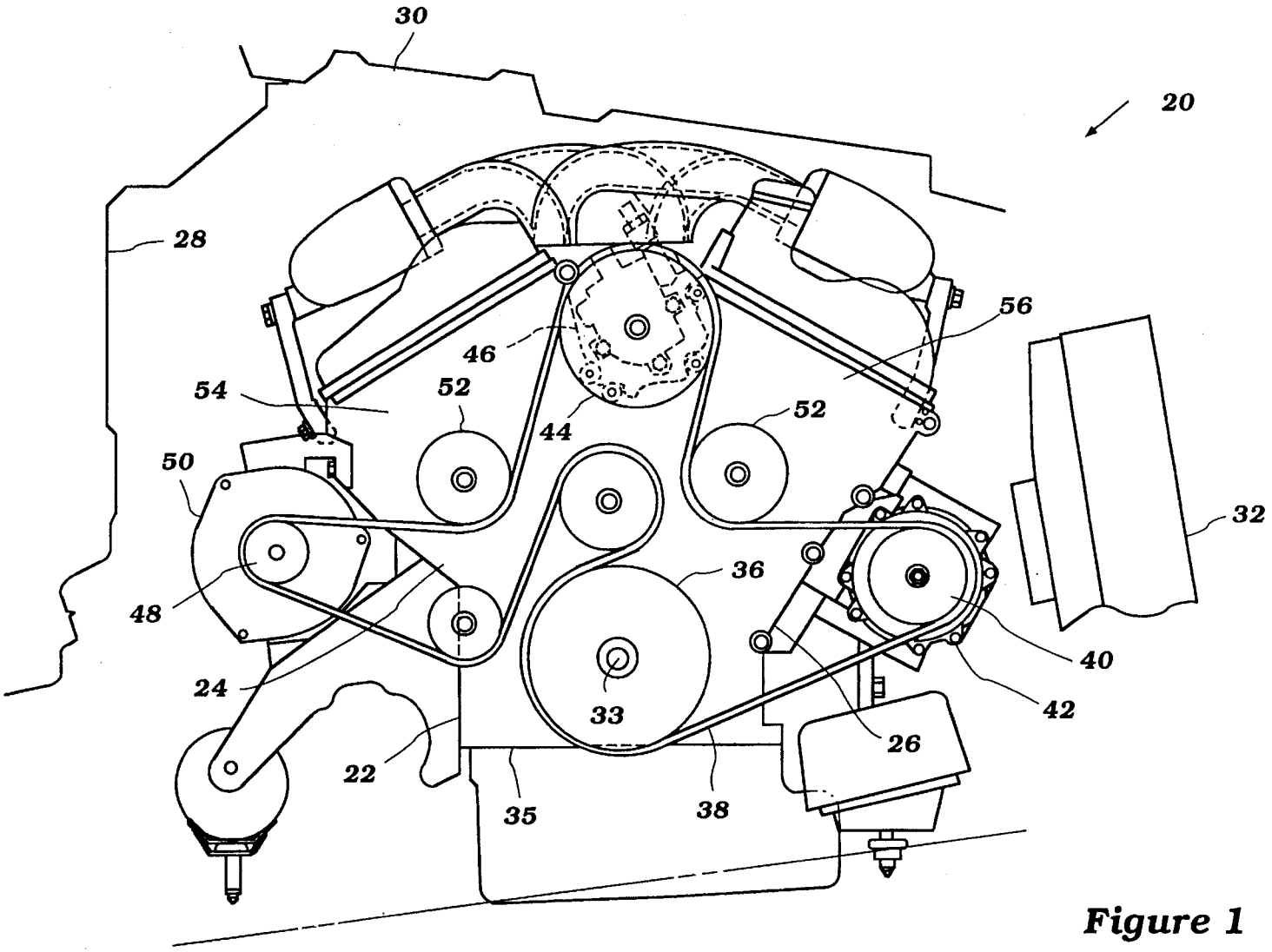
FIG. 1 is a front elevational view of an internal combustion engine constructed in accordance with an embodiment of the present invention.

In the drawings, and with particular reference to FIGS. 1–7, an engine 20 of a V-8, double overhead camshaft type, equipped with a valve train drive mechanism in accordance with the present invention is shown. A cylinder block 22 has a pair of angularly diverging cylinder banks 24 and 26. Each cylinder bank 24, 26 includes four internal cylinder bores. The cylinder bores of the left bank 24 are disposed at an angle relative to those of the right bank 26, and in the illustrated embodiment, this angle is 60 degrees. V-type internal combustion engines, such as the engine 20 described herein, are generally defined by the outwardly diverging cylinder banks 24, 26, having a central valley therebetween. The "inboard" side of each cylinder bank 24 or 26 is the side adjacent the valley, while the "outboard" side is the side facing away from the valley. It is to be understood, however, that the present invention and certain facets herein are useful with engines of other configurations and engines having other numbers of cylinders in each bank in which the angle between the banks is other than 60 degrees. The invention, however, has particular utility in conjunction with V-type engines, and particularly those in which a very narrow or relatively shallow cylinder bank angle is employed and one which results in uneven firing impulses.

Figure 2:
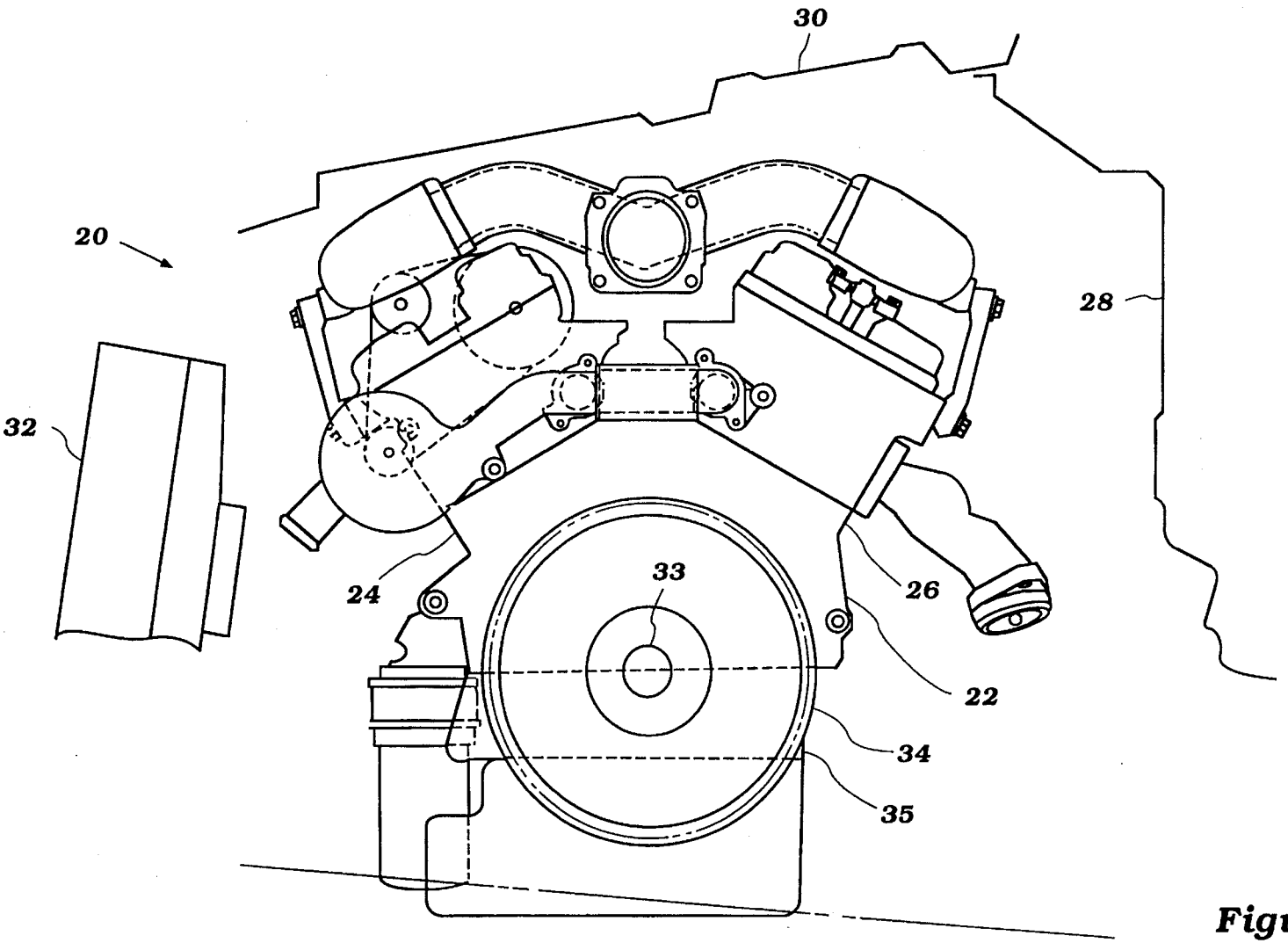
FIG. 2 is a rear elevational view of the internal combustion engine of FIG. 1.

FIGS. 1 and 2, which are front and rear views of the engine 20, respectively, illustrate the 60-degree divergence of the cylinder banks 24, 26. The engine 20 is shown mounted transversely to the longitudinal axis of a vehicle within an engine compartment, generally shown at 28, and under a sloped engine hood 30. A radiator 32 locates the forward end of the vehicle in which the engine 20 is mounted. Within the cylinder block 22, the pistons drive a crankshaft 33 on which a flywheel 34 and a drive pulley 36 are keyed. The crankshaft 33 is journalled for rotation within a crankcase 35 affixed to the underside of the cylinder block 22 and has a rotational axis transverse to the vehicle. One or more belts 38 extend around the drive pulley 36 and around a plurality of coplanar engine device pulleys. In particular, the belt 36 drives a first pulley 40 of an air condition compressor or power steering pump 42, a second pulley 44 of a fuel pump 46, and a third pulley 48 of an alternator 50. In addition, a plurality of idler pulleys 52 are arranged between the aforementioned device pulleys to maintain tension on the belt 38 and the desired path for the belt 38.

Figure 5:
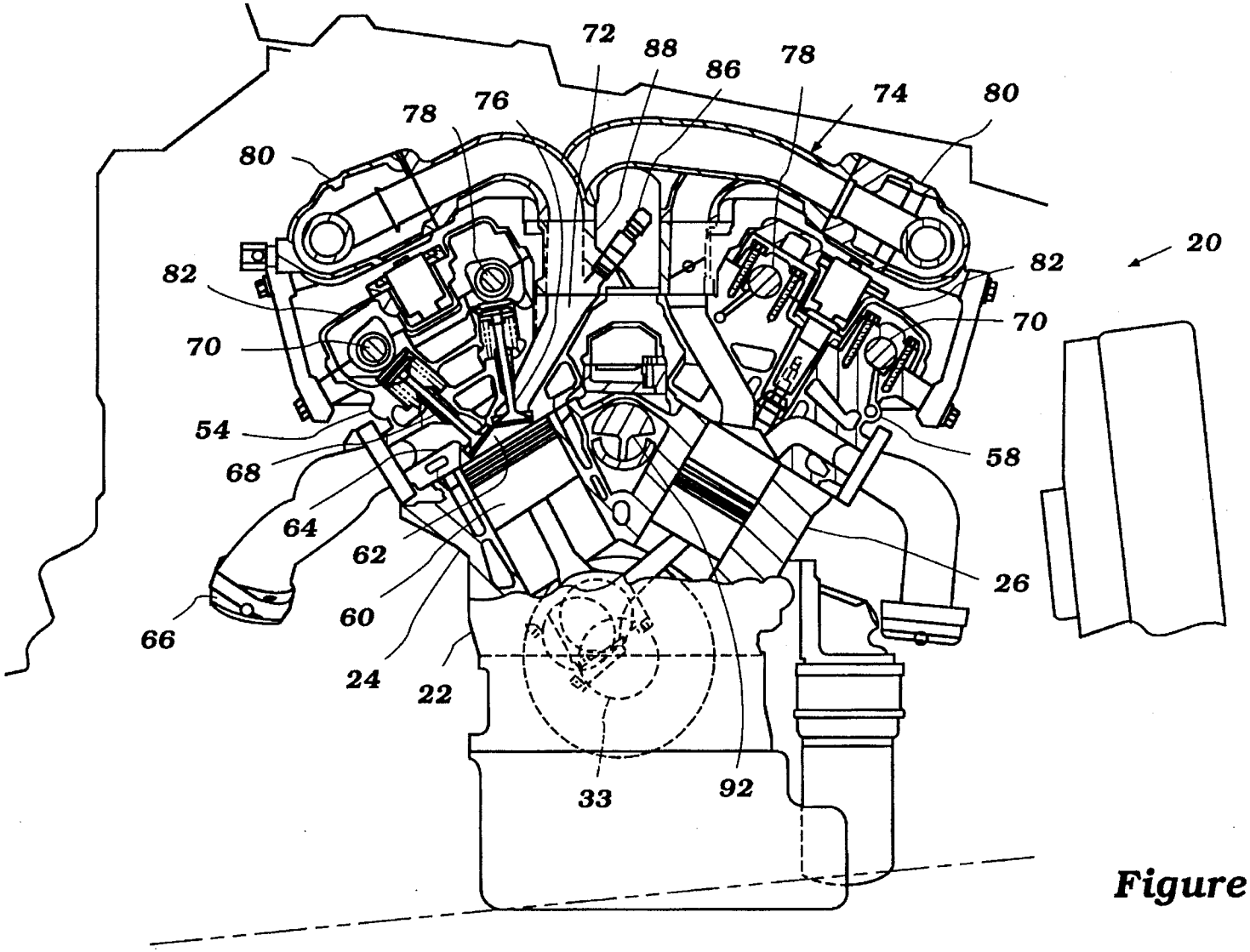
FIG. 5 is a front elevational view of the internal combustion engine of FIG. 1 with portions shown in section, taken generally along line 5—5 of FIG. 3.
Figure 6:
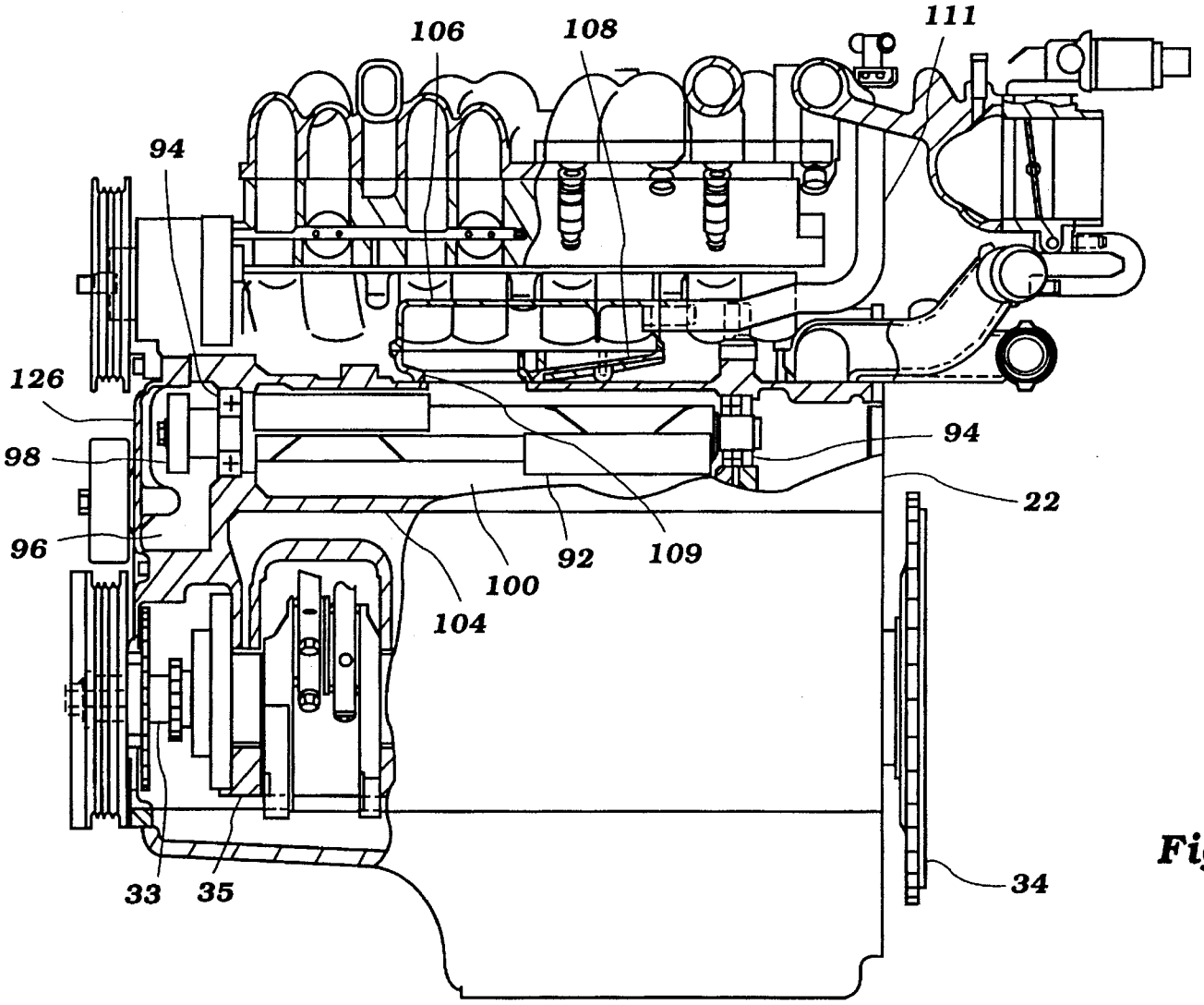
FIG. 6 is a right side elevational view of the internal combustion engine of FIG. 1 with portions shown in section, taken generally along line 6—6 of FIG. 3.
Figure 7:
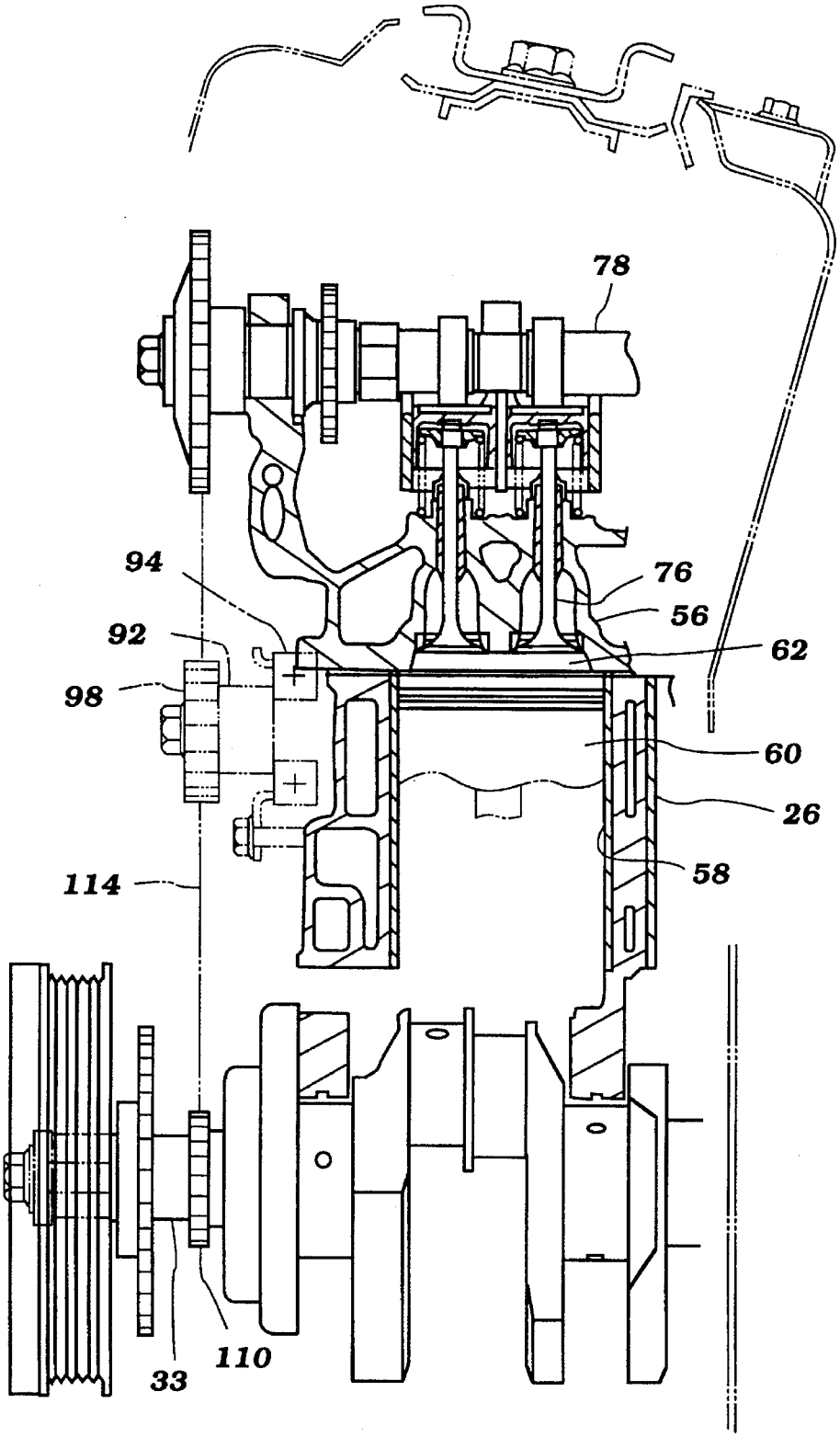
FIG. 7 is a partial sectional side view of the engine of the present invention showing a preferred valve train drive assembly.

Now, with particular reference to FIGS. 5–7, a left cylinder head 54 is mounted on the left cylinder bank 24, while a right cylinder head 56 is mounted atop the right cylinder bank 26. Each cylinder bank 24, 26 is provided with a respective series of cylinder bores 58 in which pistons 60 are supported for reciprocation. Each cylinder head 54, 56 has a recess cavity 62 formed therein for each of the cylinder bores 58. Each bore 58, piston 60 and cavity 62 form the combustion chambers of the engine, although the reference numeral 62 will be, at times, referred to as the combustion chambers. As will be explained below, a pair of intake valves and a pair of exhaust valves are positioned in each cavity for controlling the flow of combustion gasses to and from the combustion chambers 62.

The combustion chambers 62 are generally hemispherical in shape, and each chamber is provided with a pair of exhaust passages 64 (FIG. 5) formed in the respective cylinder head 54 or 56, which extend from ports opening into the chambers 62 and which are adapted to cooperate with respective exhaust manifolds 66. Exhaust valves 68 are reciprocally supported in each of the cylinder heads 54, 56 and control the communication of the cylinder head exhaust passages 66 with the combustion chambers 62. The exhaust valves 68 associated with each cylinder bore 58 are operated in a suitable manner, as by means of an overhead mounted camshaft 70 via, for example, thimble tappets. While the number may vary, there are typically two exhaust valves 68 per cylinder, with the ports of the exhaust passages 66 into the combustion chamber 62 being located to the outboard side of the hemispherical chamber.

On the inboard sides of the hemispherical combustion chambers 62 from the exhaust valves 68, each cylinder head 54 and 56 is provided with a pair of intake passages 72 leading from an air induction system 74. The intake passages 72, much like the exhaust passages 66, terminate at the combustion chamber 62 in valve ports, which are selectively opened and closed by intake valves 76. The intake valves 76 are supported in each of the cylinder heads 54, 56 and control the communication of the intake passages 72 with the combustion chambers 62. The intake valves 76 associated with each cylinder bore 58 are operated in a suitable manner, as by means of an overhead-mounted camshaft 78. The intake camshafts 78 operate the intake valves 76 in a known manner, such as, for example, through thimble tappets. Although a four valve arrangement is used for each cylinder the invention can be used with engines having other numbers of valves per cylinder.

There are four camshafts, two per cylinder bank 24, 26. The intake camshafts 78 are disposed on the inboard side of the cylinder heads adjacent the valley between cylinder banks 24, 26, while the exhaust camshafts 70 are disposed on the outboard side of the cylinder heads 54, 56. Said another way, the intake camshafts 78 of the respective cylinder heads 54, 56 are adjacent to each other and the valley. The axes of rotation of the intake camshafts 78, exhaust camshafts 70, and crankshaft 33 are all parallel to but offset from each other and all extend transversely to the motor vehicle.

Figure 3:
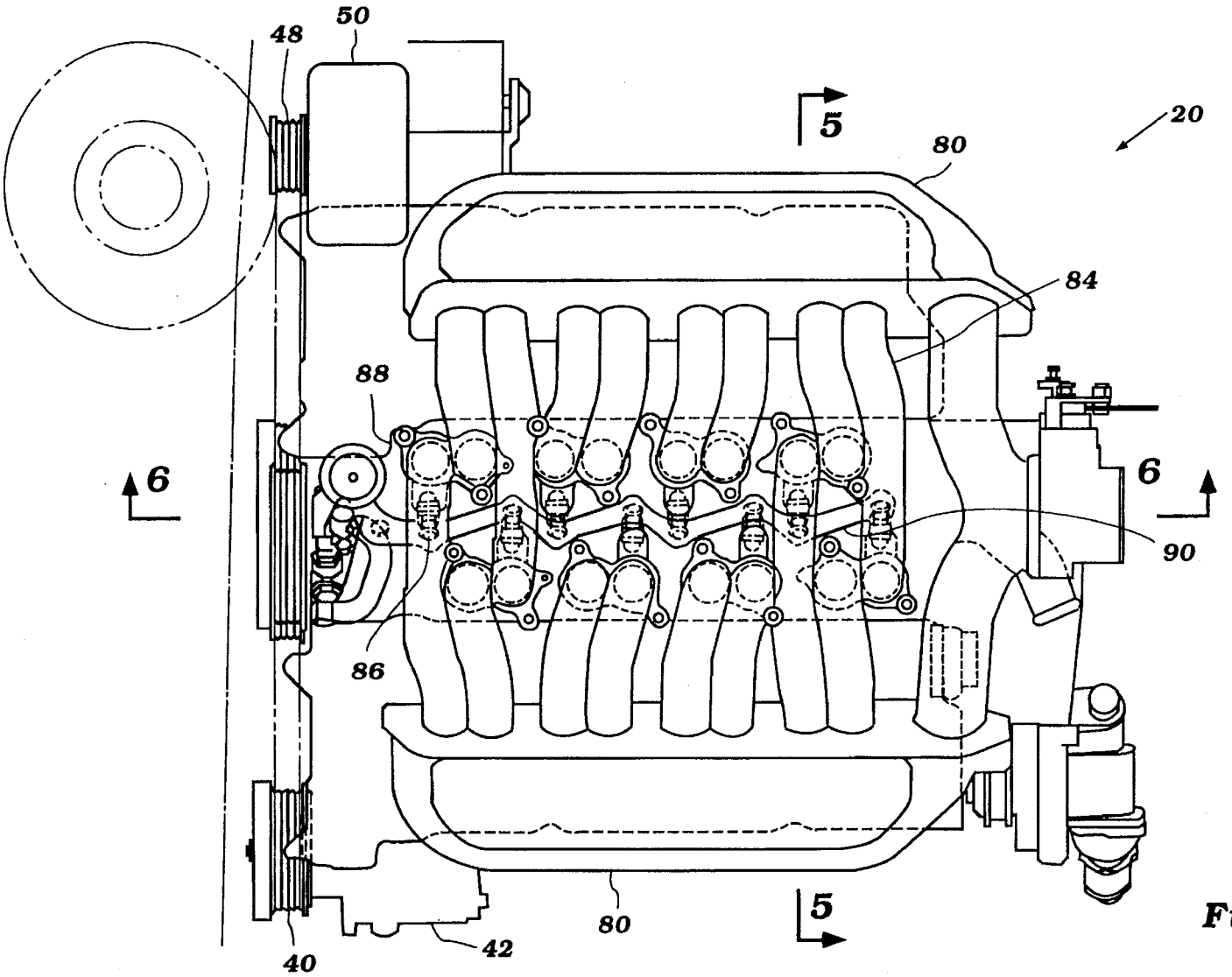
FIG. 3 is a top plan view of the internal combustion engine.
Figure 4:
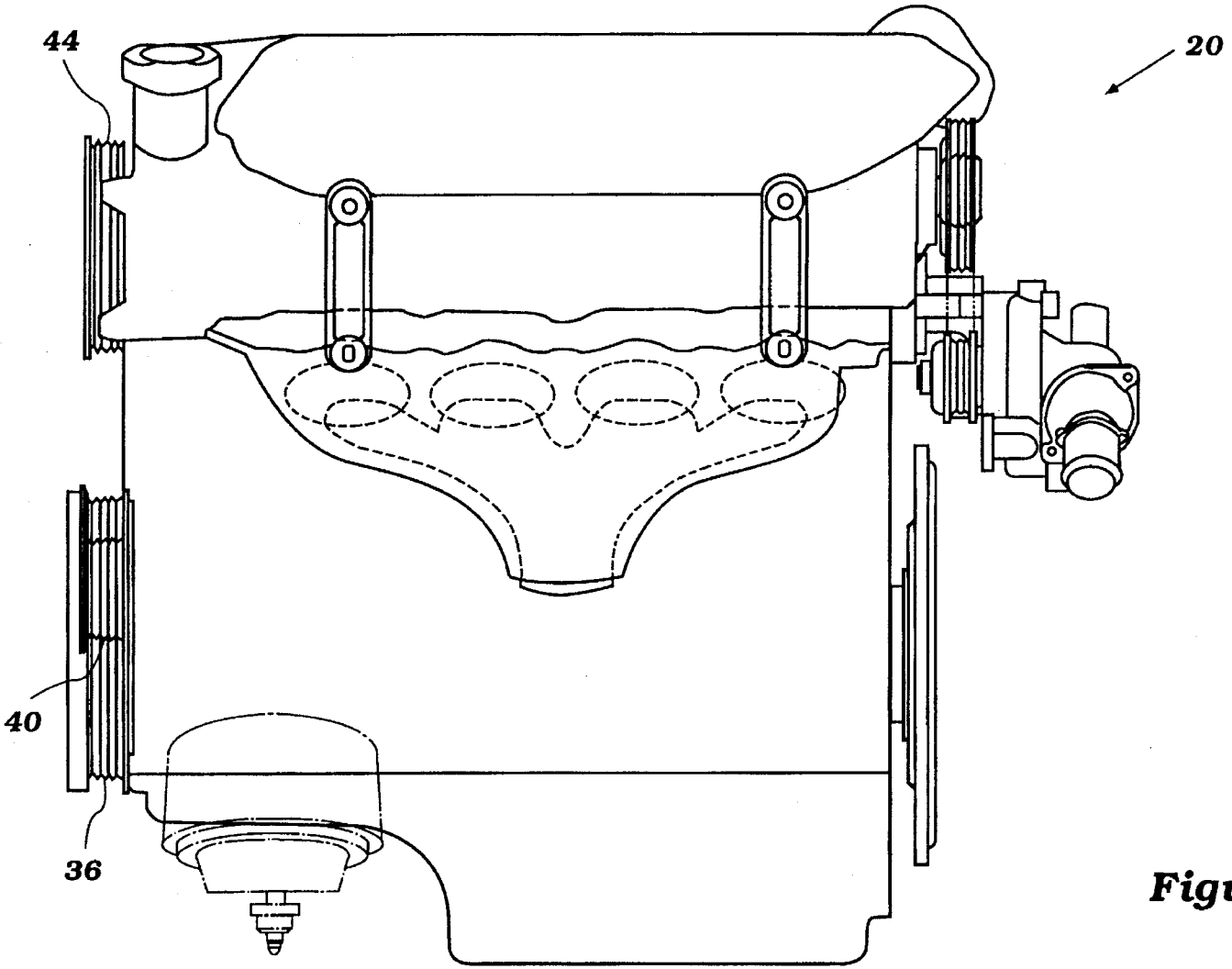
FIG. 4 is a right side elevational view of the internal combustion engine of FIG. 1.

The present engine 20 incorporates an improved induction system 74, which permits a compact engine configuration and the tuning of two different intake passages for each cylinder for different engine speed ranges. As seen in FIGS. 3 and 5, the induction system generally comprises a pair of plenum chambers 80 mounted atop the cam covers 82 above each cylinder head 54, 56; an intake manifold 84 generally defined by a plurality of runners; and a fuel-injection system having fuel injectors 86 mounted within a throttle body 88. The central location of the induction system 74 and fuel-injection system dictates the inboard relationship of the intake passages 72 and thus the position of the intake camshafts 78 with respect to the exhaust camshafts 70. As seen in FIG. 3, a fuel rail 90 supplies fuel to the fuel injectors 86. The induction system 74 is as described in copending application of Manabu Kobayashi and Yasuo Okamoto, entitled "Intake System," Ser. No. 08/245,968, filed May 19, 1994, and assigned to the assignee hereof, the disclosure of which is incorporated herein by reference.

The engine 20 utilizes an eccentric balancing shaft, such as shaft 92 in FIGS. 5 and 6, to counterweight the unbalanced forces generated by the reciprocating crankshaft 33, pistons 60 and associated components and to compensate for the nonequal firing intervals. The balance shaft 92 is rotatably journalled in the valley between the cylinder banks of the V-type engine. In the present invention, the balancing shaft 92 is journalled for rotation in the engine block 22 with the use of a pair of bearings 94, as seen in FIG. 6. The balancing shaft 92 extends forward of the forward bearing 94 into a space 96 and has a drive sprocket 98 mounted thereon. The drive sprocket 98 is driven at the same speed as the crankshaft 33 but in the opposite sense by a flexible transmitter such as a timing chain, as will be more fully described below. The central portion of the balance shaft 92 rotates within a space 100 in the valley of the engine block 22 between the crankcase 35 and the induction system 74.

A novel arrangement for recapturing vaporized hydrocarbons carried by the crankcase ventilation gases and is best seen in FIG. 6. Such a mechanism is commonly referred to as an oil separator. One or more ports (not shown) extend through an upper wall 104 of the crankcase 35 into the rotational space 100 of the balancing shaft 92 through which the blowby gases from the cylinders which circulate through the crankcase may pass. An oil separator, indicated generally by the reference numeral 106 is disposed in the valley between the cylinder banks 24 and 26 and below the induction system 74. This oil separator 106 may be internally baffled and has an inclined lower wall 108 that will cause any oil that condenses in the separator 104 to flow back through an opening 109 into the balance shaft chamber 100 and from the balance shaft 100 back to the crankcase through the aforenoted ports in the wall 104. The crankcase ventilation gases then are reintroduced into the engine combustion chambers through a conduit 111 that extends from the rear of the oil separator 106. The balancing shaft space 100 thus communicates with the induction system 74. Vaporized hydrocarbons emitted can be recirculated and reburned in the induction system via the space 100 and conduit 111.

In an important aspect of the present invention, a valve train driving assembly comprises a flexible transmitter, which drives one camshaft of the pair of camshafts within each cylinder bank 24, 26, in addition to driving the balancer shaft 92. With specific reference to FIGS. 7–9, the camshaft/balancer shaft drive arrangement is shown. The drive arrangement comprises a drive sprocket 110 keyed or otherwise rotatably fixed with respect to the crankshaft 33, a flexible transmitter 114, a pair of driven sprockets 116*a*, 116*b* keyed to the forward ends of two of the four camshafts, and the aforementioned balancing shaft sprocket 98. As seen in FIGS. 6 and 7, the drive sprocket 110 is mounted to the forward end of the crankshaft 33, which end extends axially beyond the crankcase 35. The flexible transmitter 114 is preferably a chain but also may be a toothed belt. A front cover 126 partially shown in FIG. 6 is affixed to the engine 20 to cover the timing chain 114 and respective sprockets.

Figure 8:
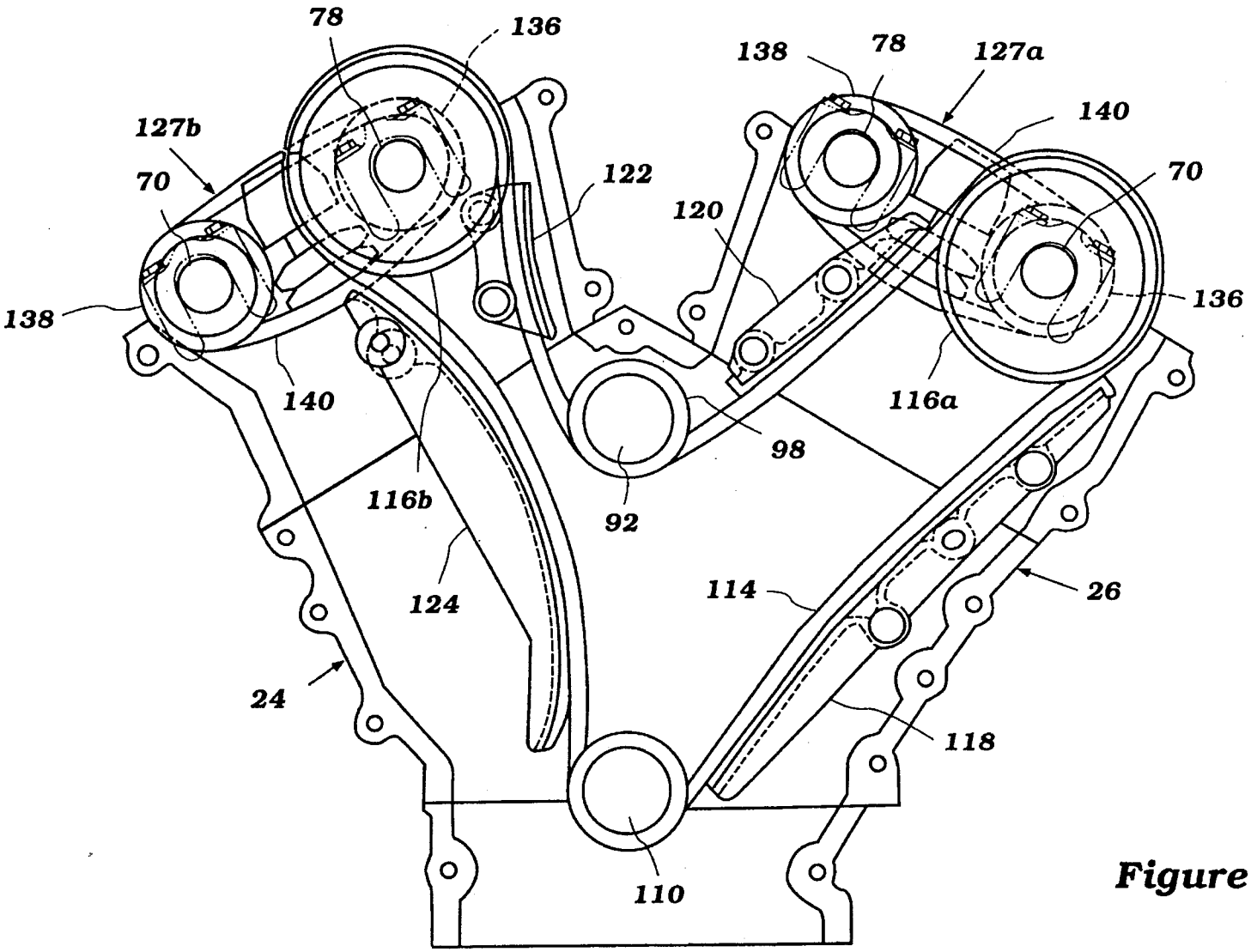
FIG. 8 is a sectional front view of the preferred valve train drive assembly.

With reference to FIG. 8, a plurality of tensioning or guide shoes are provided between the respective drive and driven sprockets to maintain the timing chain 114 in positive engagement with the respective sprockets. A first tensioning shoe 118 engages the timing chain 114 between the crankshaft sprocket 110 and a first driven sprocket 116*a*. A second tensioning shoe 120 engages the timing chain 114 between the first driven sprocket 116*a* and the balancing shaft sprocket 98. A third tensioning shoe 122 engages the timing chain 114 between the balancing shaft sprocket 98 and the second driven sprocket 116*b*. And a fourth tensioning shoe 124 engages the timing chain 114 between the second driven sprocket 116*b* and the crankshaft sprocket 110. These tensioning shoes 118–124 comprise arcuate surfaces, which may be spring-biased toward the timing chain 114 such as the shoes 120 and 124, in order to maintain a predetermined angle of wrap of the chain around the respective drive and driven sprockets.

Figure 13:
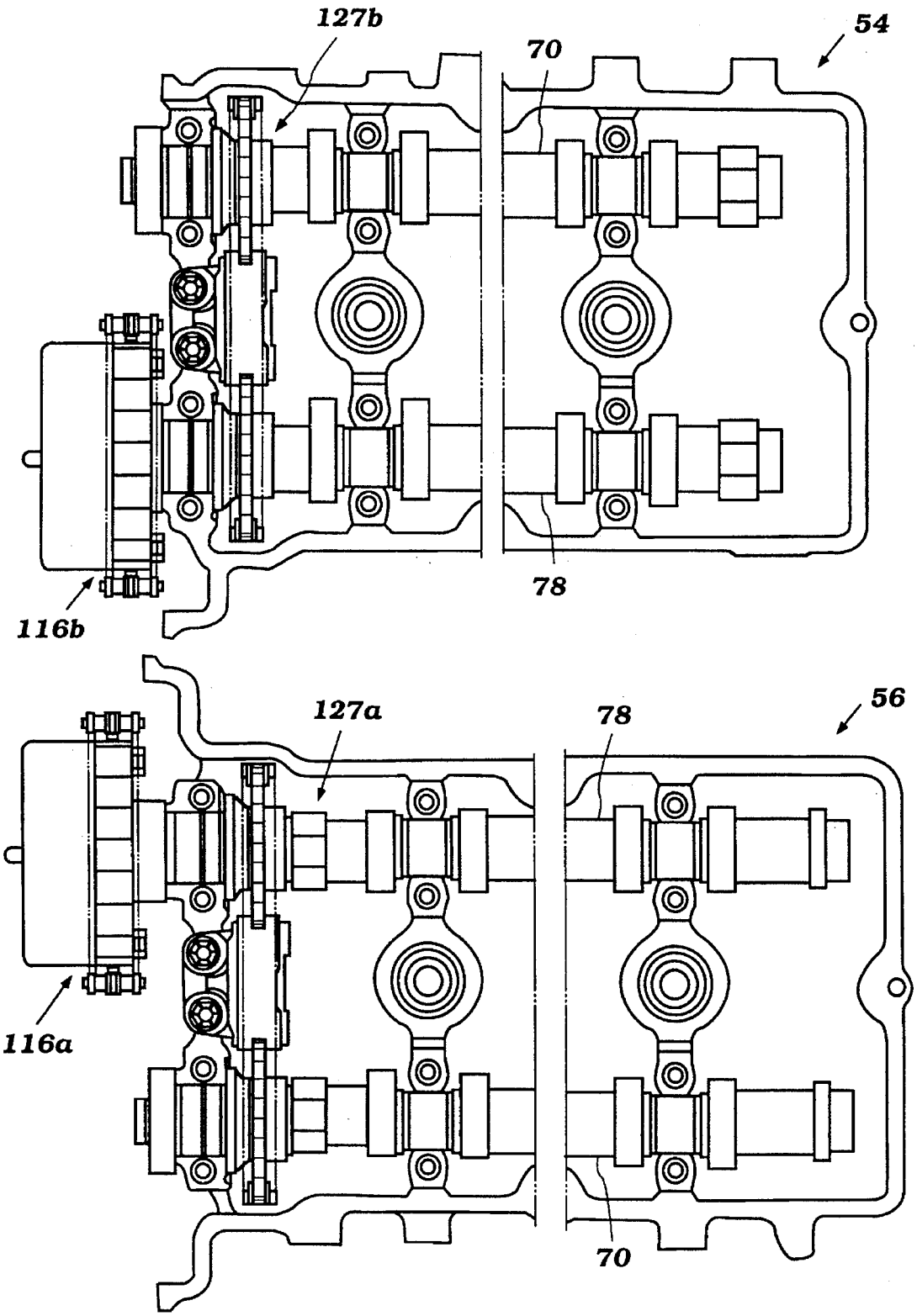
FIG. 13 is a top plan view showing a further camshaft drive configuration.

In the illustrated embodiment, the timing chain 114 extends first around the drive sprocket 110, next around the driven sprocket 116*a* of the outboard camshaft 70 of the right cylinder bank 26, continues around the balancing shaft sprocket 98, and finally around the second drive sprocket 116*b* of the inboard camshaft 78 of the left cylinder bank 24. In other words, the drive sprocket 110 of the crankshaft 33 drives an exhaust camshaft 70 of the right cylinder bank 26, the balancing shaft 92, and the intake camshaft 78 of the left cylinder bank 24. As will be later noted in other arrangements, it would be possible to drive both exhaust camshafts 70 or, both intake camshafts 78, or the opposite combination of intake and exhaust camshafts as is shown. For example, FIG. 13 shows an alternative embodiment wherein both the intake camshafts 78 are provided with drive sprockets 116, and thus the timing chain 114 would by necessity be directed along a slightly different path from that shown in FIG. 8 with the tensioning shoes modified accordingly.

The other camshaft of the pair in each cylinder bank 24, 26, which is not directly driven by the timing chain 114, is driven by way of a transmission between the camshafts. Specifically, a first transmission 127*a* transmits rotary motion from the exhaust camshaft 70 to the intake camshaft 78 of the right cylinder bank 26, while a second transmission 127*b* transmits rotary motion from the intake camshaft 78 to the exhaust camshaft 70 of the left cylinder bank 24. The specifics of the first and second transmissions 127*a,b* will be described more fully below with respect to FIGS. 9–13. Suffice it to say that in conjunction with the above discussion, the first and second transmissions 127*a,b* can transmit rotary motion from either camshaft in each cylinder bank pair to the other.

Figure 9:
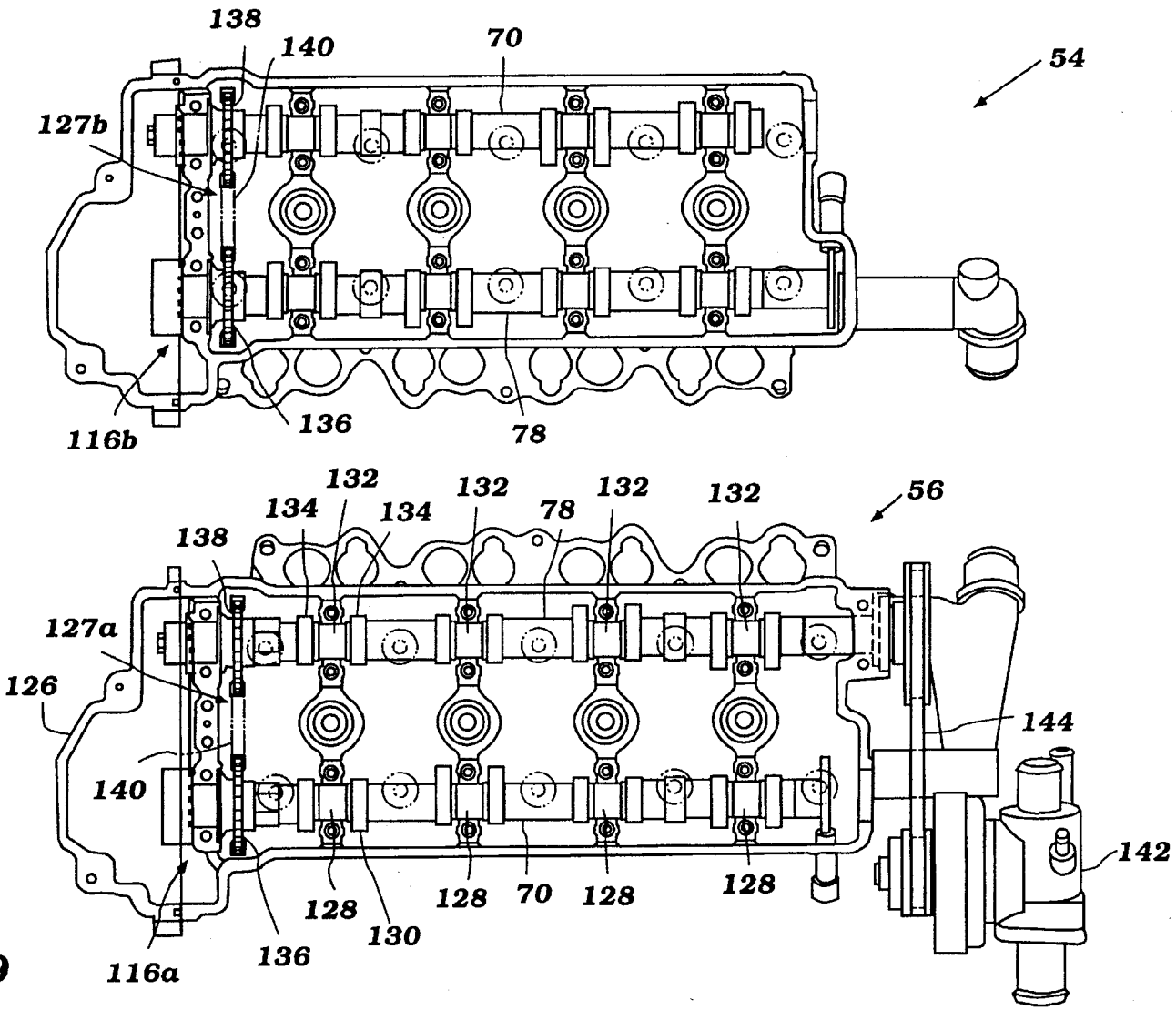
FIG. 9 is a top plan view of both cylinder heads of the engine of FIG. 1 with the cam covers removed to show a preferred camshaft assembly.

Now with reference to FIG. 9, the specific arrangement and support of the respective camshafts within the cylinder heads 54, 56 is shown. The left cylinder head 54 is depicted in the upper portion of FIG. 9 while the right cylinder head 24 is shown below. Detail components of the camshaft support arrangement are substantially identical with respect to the cylinder heads 54, 56, and thus reference will only be made to the components of the right cylinder head. An exhaust camshaft 70 is journalled for rotation within the cylinder head 56 at bearing points 128. Each bearing portion 128 separates a pair of eccentric cams 130 which operate a pair of exhaust valves 68 leading to the combustion chambers 62 in a known manner. Likewise, an intake camshaft 78 is journalled for rotation at a plurality of bearing portions 132, each of which separate a pair of cams 134 which operate to reciprocate the intake valves 76 leading to the combustion chambers 62 in a known manner. A forward end of the exhaust camshaft 70 extends axially outward from the cylinder head 56 into a space within the protective cover 126. The first driven sprocket 116*a* is keyed or otherwise rotationally fixed to the forward end of the exhaust camshaft 70. In an identical manner, the intake camshaft 78 of the left cylinder bank 24 is provided with the second driven sprocket 116*b*.

As previously mentioned, each of the two aligned camshafts 70, 78 within each cylinder head are rotatably coupled by a transmission comprising a pair of sprockets and a flexible transmitter. More specifically, and with reference to FIGS. 9 and 10, the exhaust camshaft 70 of the right cylinder head 56 includes a first transmission drive sprocket 136 keyed or otherwise rotationally fixed to the exhaust camshaft, which is coupled to a driven transmission sprocket 138 keyed or otherwise rotationally fixed to the intake camshaft 78. The sprockets 136, 138 are keyed just inside the cylinder head on their respective camshafts. The sprockets 136, 138 are coupled by a flexible transmitter, typically comprising a chain 140, the assembly comprising the first transmission 127*a*. Of course, and as was explained with reference to the timing chain 114, the flexible transmitter 140 can take a variety of configurations such as, for example, a flexible toothed belt or other similar drive. In the left cylinder head 54 the second transmission drive sprocket 136 is keyed to the intake camshaft 78, while the driven transmission sprocket 138 is keyed to the exhaust camshaft 70, the two sprockets being coupled by a flexible transmitter such as a chain 140 and the assembly comprising the second transmission 127*b*. The chains 140 within the cylinder heads 54, 56 may be provided with appropriate tensioning devices as needed. It can be seen then that the crankshaft 33 drives the exhaust camshaft 70 of the right cylinder head 56 and the intake camshaft 78 of the left cylinder head 54, with these camshafts then driving the opposite camshaft within each head via the first and second transmissions 127*a,b*. One or both of the camshafts 70, 78 within each cylinder head may also drive auxiliary devices within the engine 20, such as the water pump 142 shown in FIG. 9. This water pump 142 is driven via a belt 144 off of the intake camshaft 78 of the right cylinder head 56.

Figure 10:
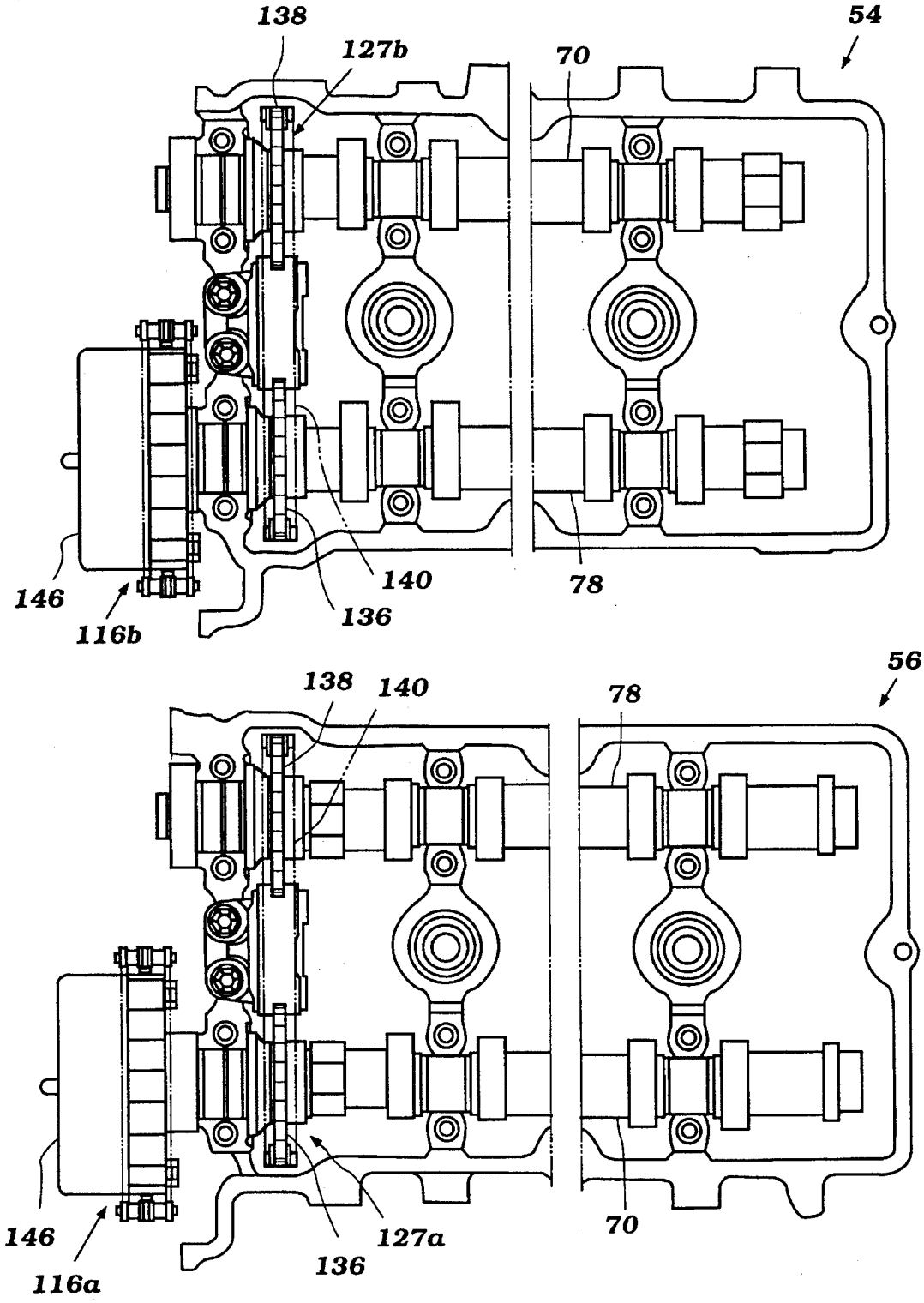
FIG. 10 is a further enlarged top plan view showing a first camshaft drive configuration.

The detailed cross-sectional view of FIG. 10 shows the first and second transmissions 127*a,b* within the respective cylinder heads in greater detail. The driven sprockets 116*a,b* may be directly coupled to the rotation of the camshafts 70, 78 or via a variable valve timing device configured within cylindrical hubs 146. The variable valve timing devices may be hydraulically operated and vary the timing of the exhaust valves and intake valves by longitudinally adjusting meshed helical splined gears between the driven sprockets 116 and associated camshafts, depending on the operational needs of the engine 20. In the present engine, the variable valve timing device varies the timing of both the intake and exhaust camshaft of each cylinder bank together with respect to the phase of the crankshaft 33. Obviously any other type of variable cam drive can be employed.

Figure 11:
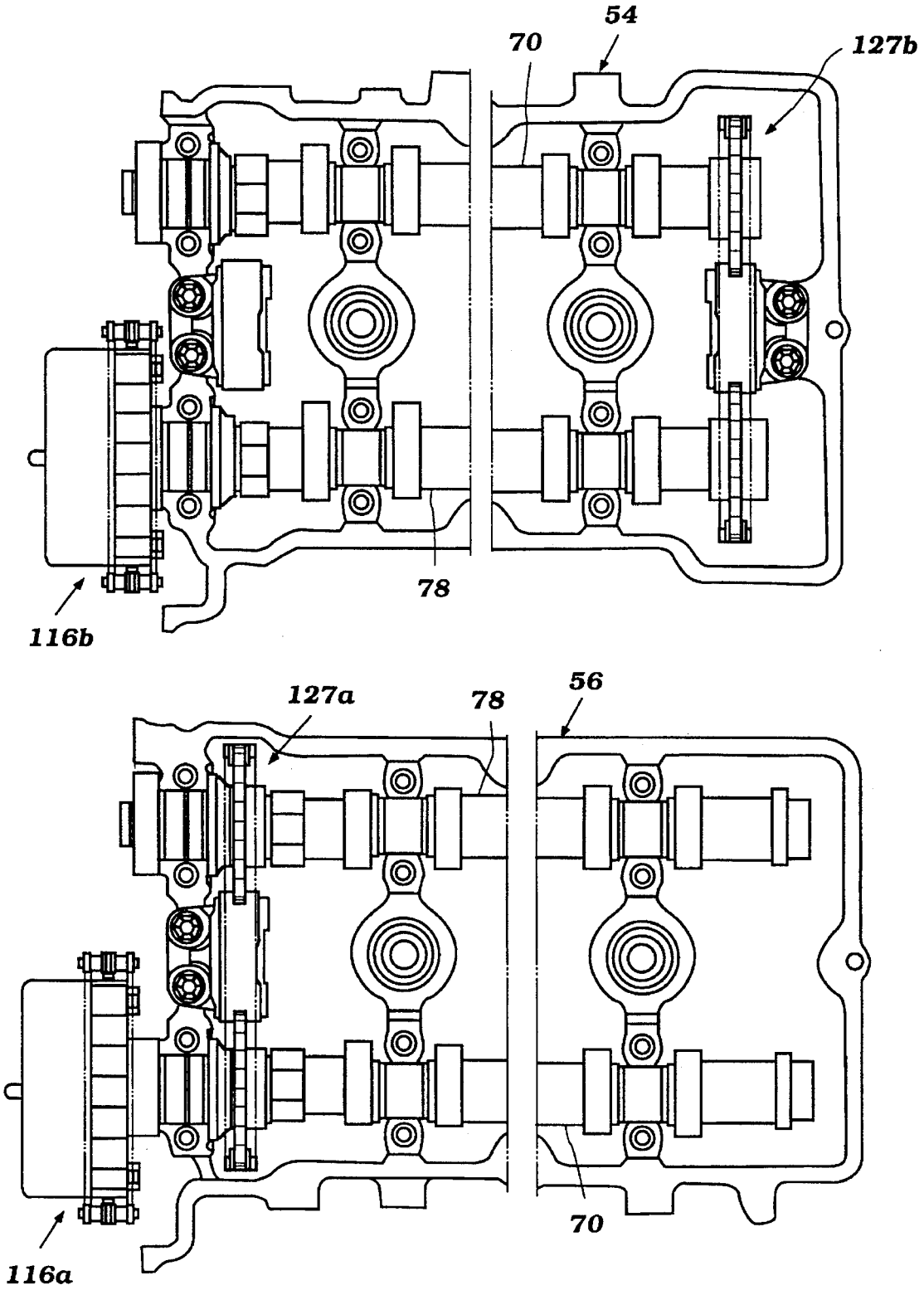
FIG. 11 is a top plan view showing a further camshaft drive configuration.
Figure 12:
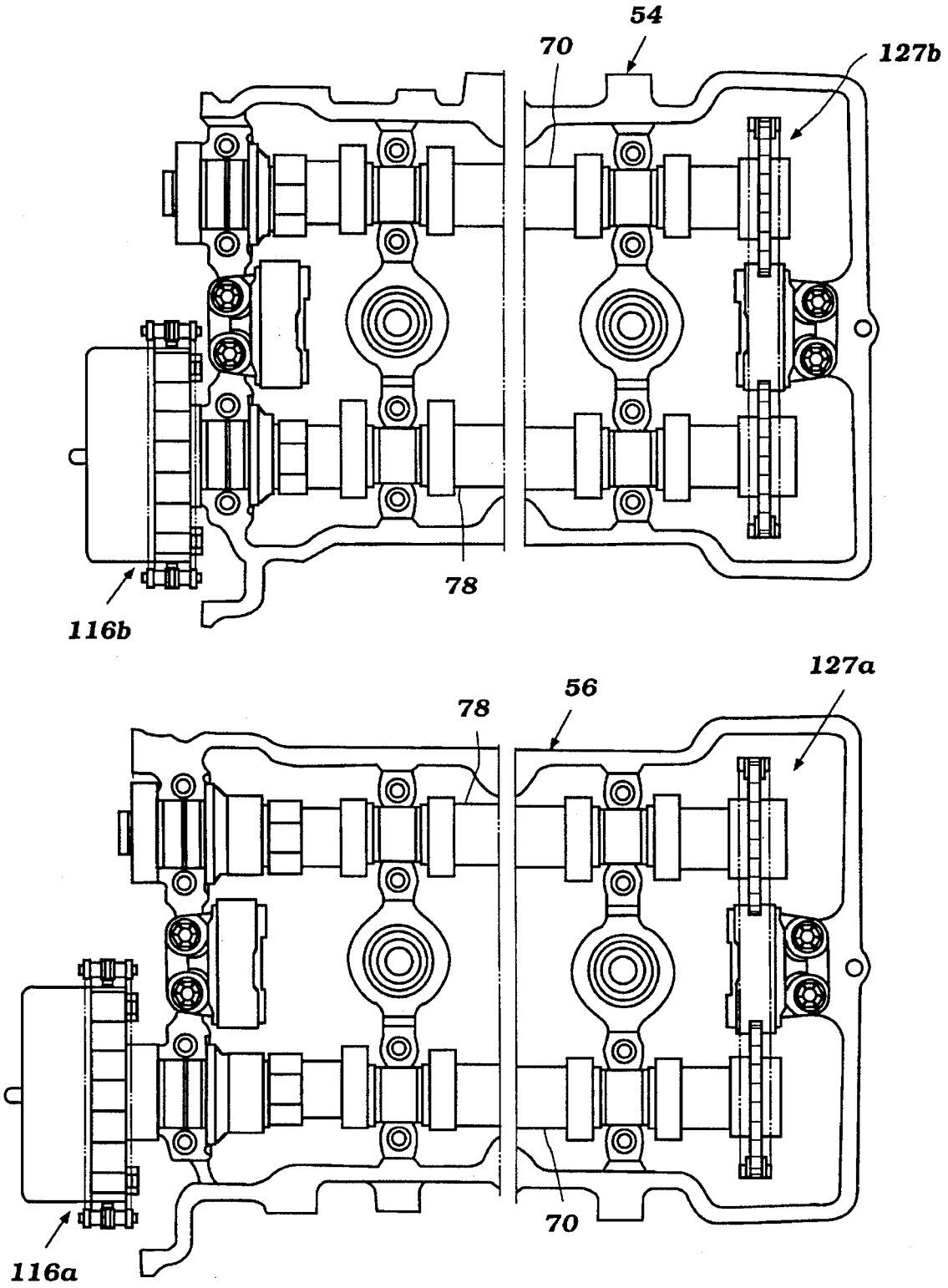
FIG. 12 is a top plan view showing a further camshaft drive configuration.

FIGS. 10–13 show cross-sectional views of the cylinder heads 54, 56 wherein several embodiments of valve train drive assemblies are shown. To reiterate, in the assembly of FIG. 10 the exhaust camshaft 70 in the right cylinder head 56 and the intake camshaft 78 in the left cylinder head 54 are driven and coupled to the opposed camshafts via first and second transmissions 127*a,b* disposed at the forward end of the cylinder heads. FIG. 11 shows a slightly different version wherein the second transmission 127*b* is located at the rear end of the left cylinder head 54. FIG. 12 shows another variation of the valve drive assembly of FIG. 10 wherein both the first and second transmissions 127*a,b* between the camshafts in each cylinder head 54, 56 are located at the rear of the heads. As previously mentioned, FIG. 13 discloses an arrangement wherein both intake camshafts 70 are driven via the crankshaft drive sprocket 110 (FIG. 9) and driven sprockets 116*a,b* are then coupled to the respective exhaust camshaft 78 via the first and second transmission 127*a,b*, respectively. Both the first and second transmissions 127*a,b* are located at the forward end of the cylinder heads 54, 56 but one or both may be located at the rear of the crankshaft, as depicted in FIGS. 11 and 12.

Although an embodiment of the invention has been illustrated and described, various changes and modifications may be made, without departing from the spirit and scope of the invention, as defined by the appended claims.

What is claimed is:

1. A camshaft drive arrangement for driving the overhead camshaft of a V-type four-cam engine comprising a cylinder block having a pair of cylinder banks disposed at a V-angle to each other and defining a valley therebetween with a crankcase formed beneath said valley and separated therefrom by an integral wall of said cylinder block forming a cavity, a pair of cylinder head assemblies each affixed to a respective one of said cylinder banks, a crankshaft supported for rotation in a crankcase about an axis disposed at the base of said cylinder block and extending generally parallel to said cavity, a first pair of camshafts rotatably journalled by one of said cylinder heads for operating the valves therein, a second pair of camshafts rotatably journalled by the other of said cylinder heads for operating the valves therein, a balancer shaft journalled directly within said cylinder block outside of said crankcase and within said cavity at the base of said valley, a first flexible transmitter driving one camshaft of each of said pairs and said balancer shaft from said crankshaft, and first and second transmissions for driving the other camshafts of said pair from the crankshaft driven camshaft, respectively.

2. The camshaft drive arrangement of claim 1, wherein the balancer shaft is disposed closer to the crankshaft axis than the axis of rotation of the camshaft driven by the first flexible transmitter.

3. The camshaft drive arrangement of claim 2, wherein the first flexible transmitter is disposed at one end of the engine.

4. The camshaft drive arrangement of claim 3, wherein the first and second transmissions are disposed at a point spaced from the one end of the engine.

5. The camshaft drive arrangement of claim 4, wherein the first and second transmissions are disposed at the opposite end of the engine from the flexible transmitter.

6. The camshaft drive arrangement of claim 2, wherein at least one of the first and second transmissions is disposed at the same end of the engine as the flexible transmitter.

7. The camshaft drive arrangement of claim 6, wherein both of the first and second transmissions are disposed at the same end of the engine as the flexible transmitter.

8. The camshaft drive arrangement of claim 6, wherein the second transmission is disposed at a point spaced from the one end of the engine.

9. The camshaft drive arrangement of claim 8, wherein the second transmission is disposed at the opposite end of the engine.

10. The camshaft drive arrangement of claim 2, wherein one of the camshafts driven directly by the first flexible transmitter is disposed on the side of the respective cylinder head adjacent the valley.

11. The camshaft drive arrangement of claim 10, wherein the other of the camshafts driven directly by the first flexible transmitter is disposed on the side of the respective cylinder head spaced from the valley.

12. The camshaft drive arrangement of claim 11, wherein the first flexible transmitter is disposed at one end of the engine.

13. The camshaft drive arrangement of claim 12, wherein at least one of the first and second transmissions is disposed at the same end of the engine as the flexible transmitter.

14. The camshaft drive arrangement of claim 13, wherein both of the first and second transmissions are disposed at the same end of the engine as the flexible transmitter.

15. The camshaft drive arrangement of claim 13, wherein the second transmission is disposed at a point spaced from the one end of the engine.

16. The camshaft drive arrangement of claim 15, wherein the second transmission is disposed at the opposite end of the engine.

17. The camshaft drive arrangement of claim 12, wherein the first and second transmissions are disposed at a point spaced from the one end of the engine.

18. The camshaft drive arrangement of claim 17, wherein the first and second transmissions are disposed at the opposite end of the engine from the flexible transmitter.

19. The camshaft drive arrangement of claim 11 wherein a spring biased tensioner is supported by the engine on the side thereof adjacent the other camshaft driven by the flexible transmitter and acts upon the flight of the flexible transmitter between the balancer shaft and the other camshaft.

20. The camshaft drive arrangement of claim 19 further including a further spring biased tensioner disposed carried by the engine and acting on the flight of the flexible transmitter between the one camshaft and the crankshaft.

21. The camshaft drive arrangement of claim 11 further including a spring biased tensioner carried by the engine and acting on the flight of the flexible transmitter between the one camshaft and the crankshaft.

22. The camshaft drive arrangement of claim 1, further including a variable valve timing mechanism interposed between the drive for at least one camshaft of each cylinder head and that one camshaft.

23. The camshaft drive arrangement of claim 22, wherein the variable valve timing mechanism is disposed between the flexible transmitter and the camshaft driven thereby.

24. A camshaft drive arrangement as set forth in claim 1 wherein the cavity in which the balancer shaft is journalled defines a pair of longitudinally spaced bearing areas for receiving bearings for journalling the opposite ends of the balancer shaft, said cavity forming a flow path for crankcase ventilation gases from the crankcase to a crankcase ventilation system disposed above said cavity and within said valley and for delivering crankcase gases to the engine through an induction system disposed in said valley.

* * * * *